US011231231B2

(12) United States Patent
Euler-Rolle

(10) Patent No.: US 11,231,231 B2
(45) Date of Patent: Jan. 25, 2022

(54) COOLER STATION FOR CONNECTION OF A LIQUID COOLER

(71) Applicant: Thomas Euler-Rolle, Vienna (AT)

(72) Inventor: Thomas Euler-Rolle, Vienna (AT)

( * ) Notice: Subject to any disclaimer, the term of this patent is extended or adjusted under 35 U.S.C. 154(b) by 394 days.

(21) Appl. No.: 15/570,043

(22) PCT Filed: Feb. 18, 2016

(86) PCT No.: PCT/AT2016/000012
§ 371 (c)(1),
(2) Date: Oct. 27, 2017

(87) PCT Pub. No.: WO2016/172741
PCT Pub. Date: Nov. 3, 2016

(65) Prior Publication Data

US 2018/0106548 A1 Apr. 19, 2018

(30) Foreign Application Priority Data

Apr. 28, 2015 (AT) ..... A 255/2015

(51) Int. Cl.
*F28F 9/02* (2006.01)
*F28D 1/053* (2006.01)
(Continued)

(52) U.S. Cl.
CPC ..... *F28D 1/05366* (2013.01); *F01M 5/00* (2013.01); *F01M 5/002* (2013.01); *F28D 1/024* (2013.01);
(Continued)

(58) Field of Classification Search
CPC .... F28D 1/05366; F28D 1/024; F28D 1/0408; F01M 5/002; F28F 9/002; F28F 9/0253; F28F 19/01
(Continued)

(56) References Cited

U.S. PATENT DOCUMENTS 5,950,713 A * 9/1999 Kato ..... F28F 9/002 165/76
6,059,322 A * 5/2000 Nagai ..... B23Q 3/102 285/125.1
(Continued)

FOREIGN PATENT DOCUMENTS

JP H11-316065 11/1999
WO 2010/135753 12/2010
WO WO-2010135753 A2 * 12/2010 ..... F28D 1/05366

OTHER PUBLICATIONS

English translation of International Search Report from corresponding PCT Appln. No. PCT/AT2016/000012 dated Jul. 1, 2016.

*Primary Examiner* — Claire E Rojohn, III
(74) *Attorney, Agent, or Firm* — Grossman, Tucker, Perreault & Pfleger, PLLC

(57) ABSTRACT

A cooler station comprising a liquid cooler, which has a first distributor box consisting of a hollow extruded section made of aluminium having outwardly open guide groove, and comprising a platform which can be pushed onto the liquid cooler and fixedly connected thereto by mechanical connecting elements which can be inserted into the guide grooves of the first distributor box. The cooler station comprises a set of platforms, wherein in each case one platform can be connected to the liquid cooler, and comprises the set of platforms which have the different hydraulic and/or electrical connections. The cooler station can be installed in a liquid cooler system which also comprises a blower, a liquid tank and a liquid filter. The liquid cooler, the blower, the liquid tank, and/or the liquid filter can each be selected from a set, such that a modular system is produced for providing from liquid cooler systems.

20 Claims, 6 Drawing Sheets

(51) Int. Cl.

| | |
|---|---|
| ***F28F 9/00*** | (2006.01) |
| ***F28F 19/01*** | (2006.01) |
| ***F28D 1/04*** | (2006.01) |
| ***F28D 1/02*** | (2006.01) |
| ***F01M 5/00*** | (2006.01) |
| *F28D 21/00* | (2006.01) |

(52) U.S. Cl.
CPC ..... *F28D 1/0408* (2013.01); *F28F 9/002* (2013.01); *F28F 9/0253* (2013.01); *F28F 19/01* (2013.01); *F28D 2021/0049* (2013.01); *F28D 2021/0089* (2013.01); *F28F 2280/06* (2013.01)

(58) Field of Classification Search
USPC ..... 165/175
See application file for complete search history.

(56) References Cited

U.S. PATENT DOCUMENTS 6,105,660 A * 8/2000 Knurr ..... F01P 3/18 165/140
6,293,011 B1 * 9/2001 Hasegawa ..... B23K 1/0012 29/890.052
6,595,272 B1 * 7/2003 Uchikawa ..... B23K 1/0012 165/134.1
6,793,121 B2 * 9/2004 Nitta ..... F28F 9/0253 228/138
7,007,499 B1 * 3/2006 Patel ..... F25B 39/04 62/298
8,011,420 B2 * 9/2011 Mazzocco ..... F28F 9/002 165/67
9,982,952 B2 * 5/2018 Lavenu ..... F28F 9/002
2006/0081363 A1 * 4/2006 Chissus ..... F28F 9/0224 165/173
2007/0251682 A1 * 11/2007 Sasaki ..... F28F 9/0221 165/153
2008/0264359 A1 * 10/2008 Marsh ..... F01P 11/08 123/41.33
2011/0272130 A1 * 11/2011 Yamazaki ..... F28D 1/05375 165/185
2012/0186795 A1 * 7/2012 Pustelnik ..... F28D 1/05366 165/170
2013/0319644 A1 * 12/2013 Moreau ..... F28F 9/0224 165/173
2014/0262158 A1 * 9/2014 Wegmann ..... F28D 15/0275 165/104.25
2014/0299301 A1 * 10/2014 Dumoutier ..... F28F 9/0224 165/173
2015/0041101 A1 * 2/2015 Hoshika ..... F28F 9/00 165/67
2016/0146548 A1 * 5/2016 Durbecq ..... F28F 1/08 165/178

* cited by examiner

COOLER STATION FOR CONNECTION OF A LIQUID COOLER

FIELD OF THE INVENTION

The present invention relates to a cooler station, comprising a liquid cooler, which has a first distributor box, consisting of a hollow extruded section made of aluminum and having outwardly open guide grooves as well as comprising a platform, which can be pushed onto the liquid cooler and fixedly connected thereto by mechanical connecting elements that can be inserted into the guide grooves of the first distribution box. Furthermore, the invention relates to a system for supplying liquid cooler installations.

BACKGROUND

Various types of liquid coolers, in particular oil coolers, are known in the prior art. With these coolers, a stream of liquid oil to be cooled is passed through hollow metal ribs that transfer heat to the ambient air and release it there. Such liquid coolers have been widely used for decades and are used as a component of engines and motors, for example, in which heated oil must be cooled down continuously during operation. Liquid coolers and/or oil coolers are not used alone but instead are part of an oil circulation system consisting of an oil tank, an oil filter and various connections. It is also known that the cooling performance of a liquid cooler can be ensured by connection to an air fan.

There is also a need for making available liquid coolers, cooler stations and liquid cooler installations having a variety of hydraulic connection options, various extra functions, such as integrated temperature measurement, various characteristic data with respect to the cooling performance, the types of filters, the oil tank sizes and additional parameters. At the same time, there is a demand for reducing the cost of manufacturing the aforementioned devices.

The cooler station according to the invention achieves this goal by the fact that the cooler station comprises a set of platforms, wherein each platform can be connected to the liquid cooler, and the set of platforms comprises platforms having various hydraulic and/or electrical connections, such that each platform of the set has the same mechanical connecting elements for connection to the liquid cooler.

SUMMARY

A preferred specific embodiment of the cooler station is characterized in that the liquid cooler has a second distributor box comprising outwardly open guide grooves for attachment to a base.

In one specific embodiment of the invention, the first distributor box has a liquid drain line guided coaxially to the liquid inlet line within an opening.

Regarding the further embodiment of the invention, the set of platforms comprises at least two members.

In one embodiment of the liquid cooler installation, it is preferable that at least one platform of the set of platforms has an electrical thermometer for measuring the temperature of the liquid.

In one specific embodiment of the invention, at least one platform from the set of platforms has a replaceable liquid filter.

In another specific embodiment of the invention, at least one platform from the set of platforms has at least one flange for a tight connection of the platform to a section of an external frame, rack or the like.

One preferred specific embodiment of the cooler station is characterized in that the cooler station comprises a set of liquid coolers consisting of liquid coolers of various cooling performance levels, wherein each liquid cooler of the set has the same mechanical and hydraulic connections and has the same installed width.

Regarding the further embodiment of the invention, the cooler station has a frame connected to the liquid cooler, by means of which the cooler station can be set up as a free-standing installation, and in which a spatial volume is formed, in which at least one liquid cooler and one fan can be accommodated at the same time, and wherein the cooler station has a base on which connections for a liquid cooler, a fan and a liquid tank are provided and wherein the base has an insertion opening for a liquid cooler, which is disposed in such a way that the liquid filter can be inserted into the insertion opening and into the liquid tank in the condition in which it is connected to the base.

A preferred specific embodiment of the cooler station is characterized in that it is connected to the following four elements: a liquid cooler, a fan, a liquid tank and a liquid filter.

The system according to the invention for providing liquid cooler installations comprises at least one cooler station as well as:

- a set of liquid coolers, consisting of liquid coolers of various cooling performance levels, wherein each liquid cooler of the set has the same mechanical and hydraulic connections and the same installation width,
- a set of fans, consisting of fans of various performance levels, wherein each fan of the set has the same mechanical and electrical connections as well as the same outside dimensions, and
- a set of liquid tanks, consisting of liquid tanks of various capacities, wherein each liquid tank of the set has the same connections and the same installed width,
- a set of liquid filters, consisting of liquid filters of various characteristic values, wherein each liquid filter of the set has the same mechanical and hydraulic connections.

A preferred specific embodiment of the invention is characterized in that the set of liquid coolers and/or the set of fans and/or the set of liquid tanks and/or the set of liquid filters has at least two members.

BRIEF DESCRIPTION OF THE DRAWINGS

The invention is explained in greater detail below on the basis of one exemplary embodiment which is illustrated in the drawings, in which.

DETAILED DESCRIPTION

Figure 1:
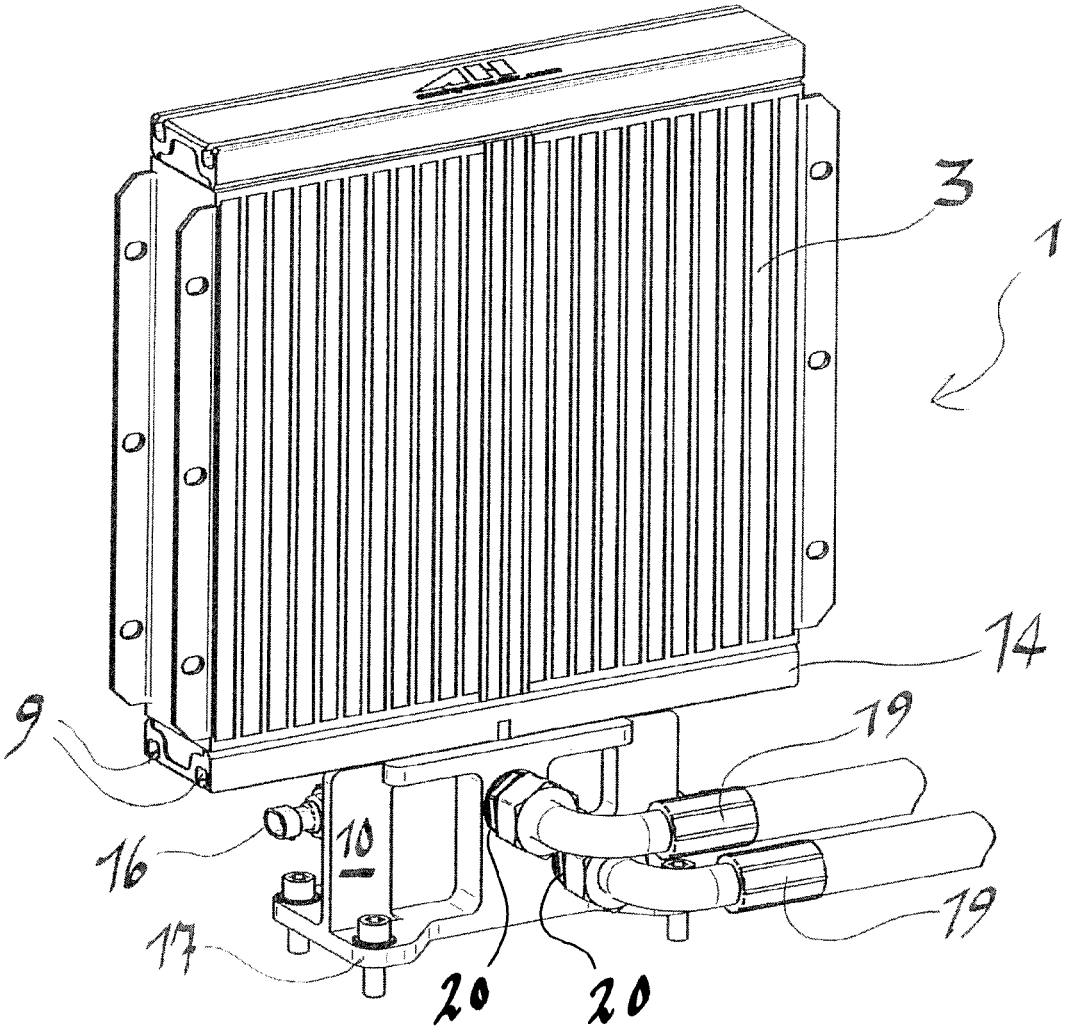
FIG. 1 shows a perspective view of the cooler station.

According to FIG. 1, the cooler station 1 consists of a liquid cooler 3 connected to a platform 10. The platform 10 is selected from a set of many platforms 10, each having different hydraulic, mechanical or electrical connections, depending on the customer's wishes. However, each platform 10 from this set can be connected to the liquid cooler 3 in the same way. The connection is established by setting or, if necessary, pushing the platform 10 onto the distributor box 14 of the liquid cooler, which has two T grooves 9 as outwardly open mechanical connecting means. Then, according to FIG. 2, the platform has matting mechanical connecting elements 15, which engage in the fitting T grooves 9 on the distributor box 14.

A plurality of cooler stations 1 with different parameters can be made available in this way by using only a few modular elements. In addition, the liquid cooler 3 can be selected from a set of liquid coolers 3 with various cooling performance levels. The mechanical connection to a platform 10 is always accomplished in the same way (see above).

In the example illustrated in FIG. 1, the platform 10 has connections 20 for the liquid inlet line and the liquid outlet line 19 as well as an integrated thermometer 16 for determining the temperature of the liquid (preferably the liquid leaving the liquid cooler 3). Furthermore, the platform 10 is equipped with flanges 17, so that the cooler station as a whole can be mounted on the frame of a surrounding structure, motor or machine (not shown). Alternatively, the liquid cooler 3 is equipped with a distributor box 13 on its side facing away from the platform 10 and having T grooves 9 of the same predetermined standard. The cooler station 1 can therefore be connected to additional elements or to a machine (not shown) according to a selected system within the invention.

Figure 2:
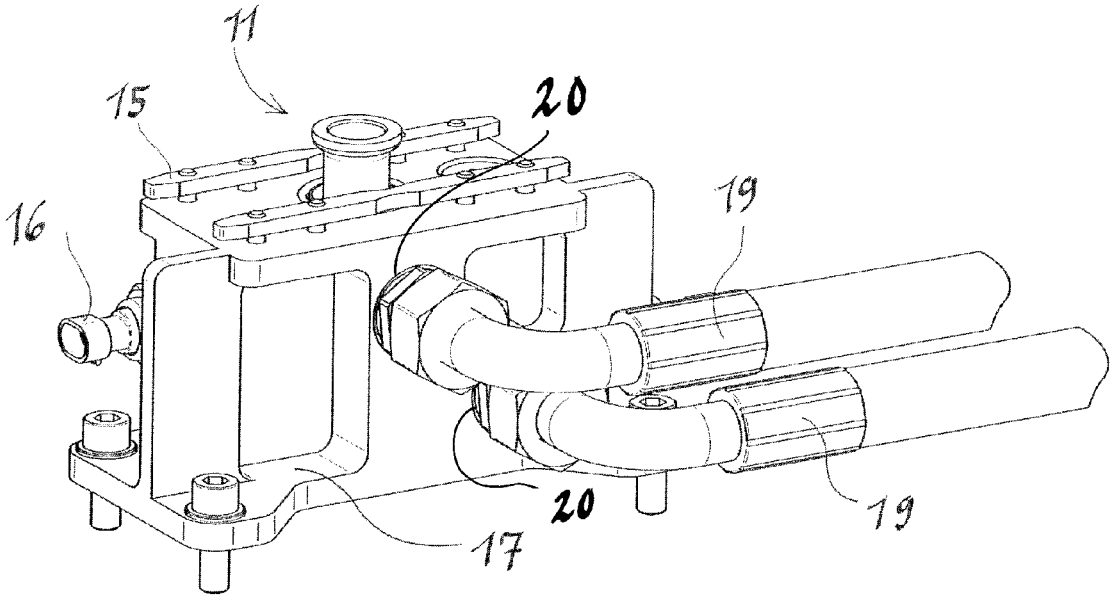
FIG. 2 shows a perspective view of the platform.
Figure 3:
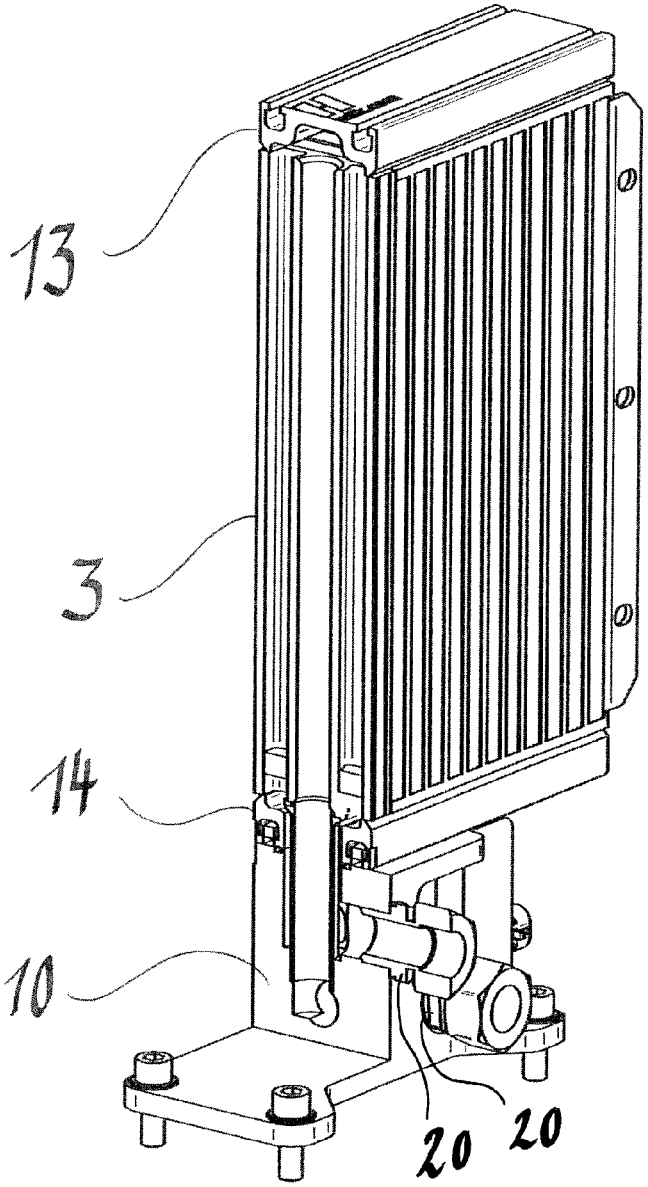
FIG. 3 shows a section through the cooler station.

As is known in the prior art, the distributor boxes 13 and 14 consist of a hollow extruded section of aluminum. Distributor boxes 13, 14 in the past were provided with two openings, one opening for the liquid inlet line and one opening for the liquid outline line. According to the invention, these two openings, as shown in FIGS. 2 and 3, are combined into one joint opening 11, which is made possible by a coaxial guidance of the liquid inlet line and the liquid outlet line. Inside the platform 10, separate connections for the liquid inlet line and the liquid outlet line are combined coaxially. According to FIG. 3, the hydraulic counterpart to the opening 11—yet another opening—is situated in the distributor box 14 and in the liquid cooler 3 on the whole, where the two streams that are guided coaxially are separated, so that liquid from the liquid inlet line is carried first to the distributor box 13, whereupon the liquid stream inside the distributor box 13 is distributed to the hollow ribs. At the other end of the hollow ribs, all the liquid streams inside the distributor box 14 are combined again and sent to the liquid outlet line. This design has the advantage that the number of required gaskets (between the distributor box 14 and the platform 10 here) in connecting the liquid inlet line and outlet line to a liquid cooler 3 can be reduced from two to one.

Figure 4:
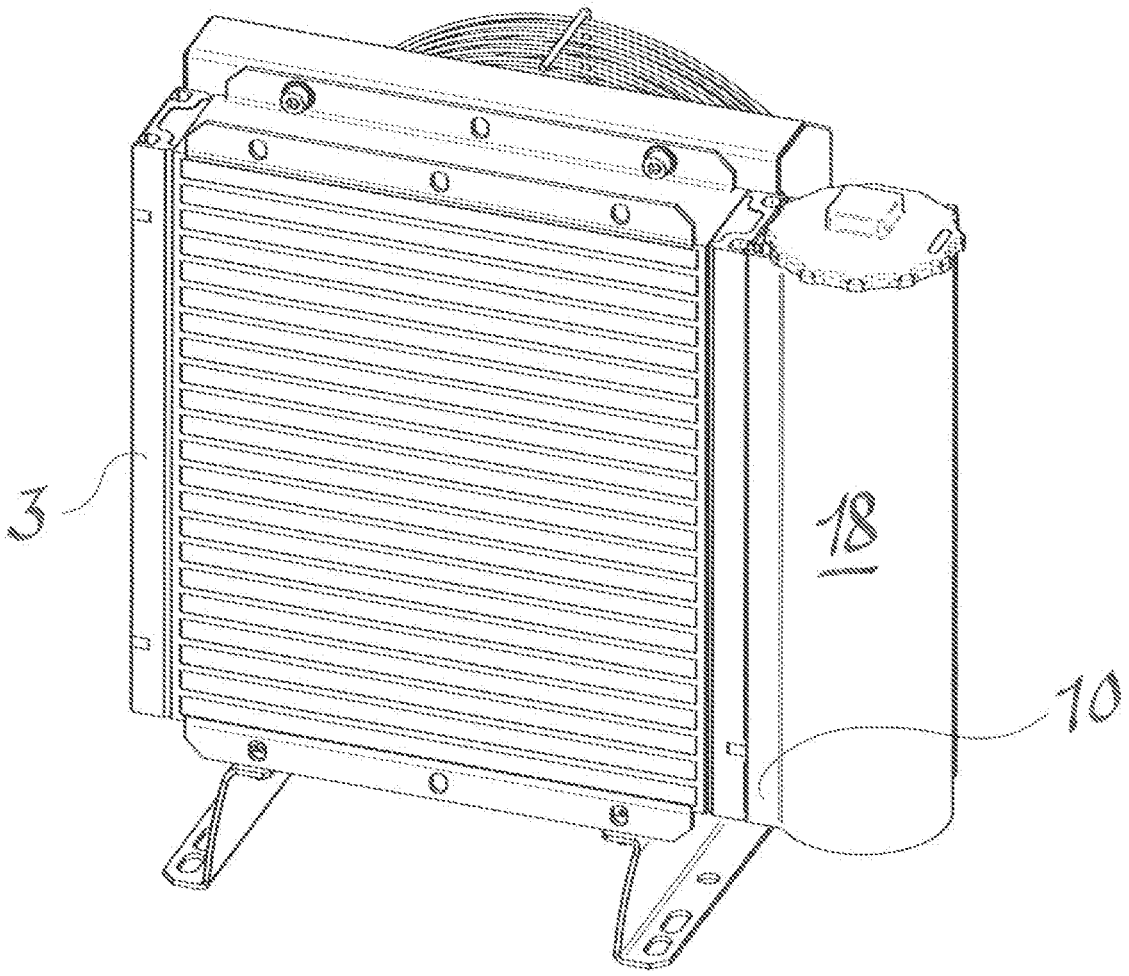
FIG. 4 shows a perspective view of the cooler station.

According to FIG. 4, a liquid filter 18 may be integrated into one of the platforms 10 to which the liquid cooler 3 can be connected.

Figure 5:
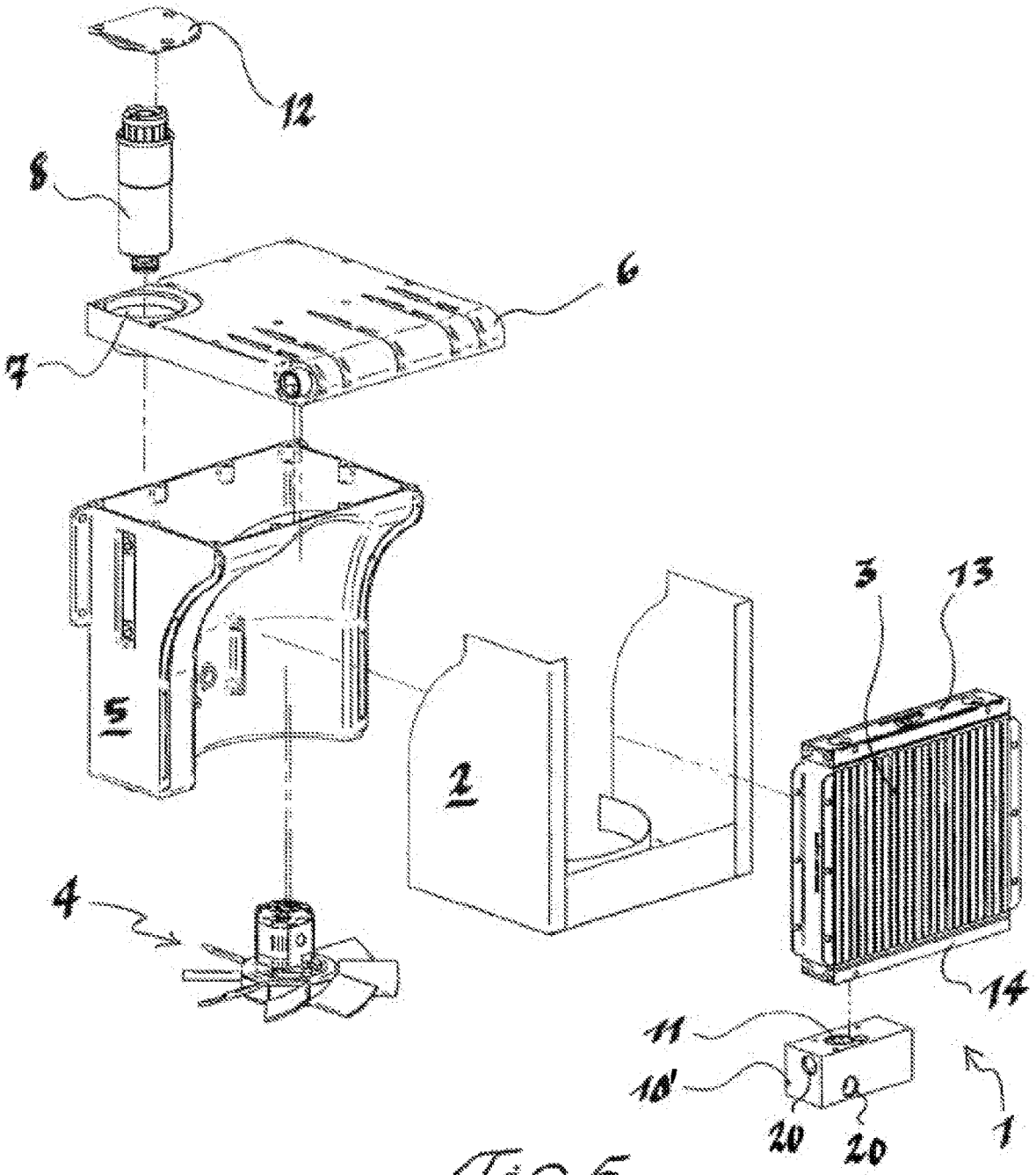
FIG. 5 shows an exploded diagram of the liquid cooler installation.

The cooler station 1 together with the idea of modular design can be expanded to a liquid cooler installation. According to FIG. 5, the central part of a liquid cooler installation remains the cooler station 1, consisting of a liquid cooler 3 and a platform 10, shown as platform 10' (which includes connections 20 for the liquid inlet line and the liquid outlet line 19), selected from a set, as shown in FIG. 1. A base 6 and a frame 2 offer connection options for the cooler station 1, a fan 4, a liquid tank 5 and a liquid filter 8 (unless the latter is already integrated into the platform 10' or if a second filter 8, in addition to filter 18, is desired in the platform 10'. Depending on the design, the term "connections" is understood to refer to mechanical connections (screw connections, hooks or sections for a suspension, etc.), electrical connections or hydraulic connections (connections in an oil circulation). In addition, the base 6 and the frame 2 define the volume, in which the components of the liquid cooler installation have a place in the most compact possible assembly. The base 6 is therefore designed essentially as a cover for the cooler station 1 and/or the liquid cooler installation, which defines the width B and the depth T of the liquid cooler installation. For example, the base 6 may have an almost square footprint, i.e., the width B and depth T are essentially the same in size. The frame 2, which is connected to the base 6, then determines the height H of the cooler station 1 and/or of the liquid cooler installation as a whole. If the height H is essentially the same as the width B and the depth T, then the liquid cooler installation has the contour of a cube. To complete the liquid cooler installation, the following four elements are installed into this cooler station 1: a liquid cooler 3, a fan 4, an oil tank 5 and an oil filter 8. Each of these four components can be selected from a set to select the parameters of the liquid cooler installation, such as the size of the oil tank, the cooler efficiency, power consumption, etc. (see below).

Figure 6:
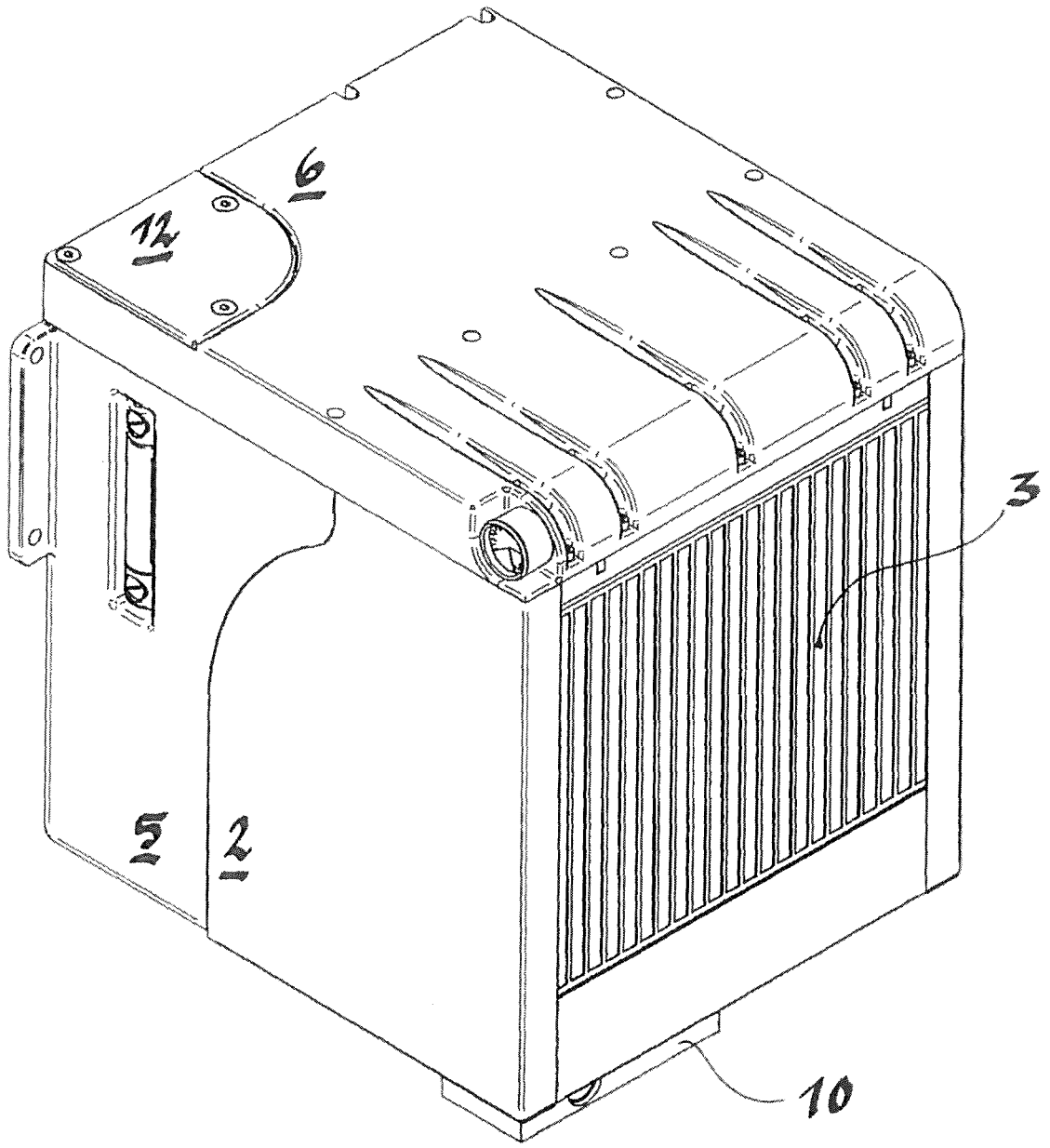
FIG. 6 shows a schematic perspective view of an assembled liquid cooler installation.

The liquid cooler installation according to the invention, as shown in FIG. 6, may be installed as free-standing units. In other words, each of its sides may be used as the base area for the installation without requiring any aids to prevent the unit from being overturned directly or falling over because of possible but nondestructive impacts. However, a suspension on an external frame (not shown) or on a pedestal and/or feet (not shown) might be appropriate (for example, for an uninterrupted supply of cooling air) during operation of the liquid cooler installation.

The result is a system for making available liquid cooler installations, the advantage of which is that the installations can be adapted to a broad range of variation in requirements, although each one has the same cooler station 1 or the same combination of a base 6 and a frame 2 as the core items. The external dimensions with regard to the width B, depth T and height H according to FIG. 6 remain the same with all the liquid cooler installations of the system. The modular design of the liquid cooler installations results in a reduction in the cost of manufacturing.

Another advantage of the invention is that the liquid cooler installations of the system are designed to be very compact and user friendly at the same time. The components work together: the frame 2 forms a part of the housing and a part of the air duct for the liquid cooler 3 at the same time. The tank 5 functions as an air duct for the fan 4 at the same time. The base 6 functions as part of the housing and as a mechanical connection point for the liquid cooler 3 and the tank 5 at the same time.

The liquid cooler 3 is designed as a plate cooler, a parallelepiped package of hollow ribs being disposed between two vertical boxes. While the cooler station 1 provides the mechanical connection points for the liquid cooler 3, the liquid inlet line and the liquid outlet line are established by means of a platform 10 connected to the distributor box 14. The distributor boxes 13 and 14 have guide grooves 9 as described above, into which the heads of connecting screws, for example, can be inserted. The guide grooves illustrated in this example have a T-shaped cross section. The platform 10 can be pushed easily, reliably and quickly onto the distributor box 14 in this way and bolted securely at the desired location.

Part of the system for providing liquid cooler installations is a set of at least two liquid coolers 3, which differ from one another in that they each offer a different cooling performance. On the other hand, the liquid coolers 3 from the series forming the set of liquid coolers 3 are similar to one another in that they have the same width (in the direction of the width B of the base 6), so they can be installed in the liquid cooler installation using the same means and operations.

A fan 4 comprised of a set of fans 4 can be installed in the cooler station 1. In the exemplary embodiment shown in FIG. 5, the tank 5 constitutes the mechanical connecting point for the fan 4. The electrical connections are established via the base 6. All fans 4 from the set of fans 4 are the same in their mechanical and/or electrical connection options. They differ, for example, in their performance, i.e., in the volume of air delivered per unit of time.

The liquid tank 5, which is to be connected to the base 6, is one member from a set of liquid tanks 5. All the members of the set of liquid tanks 5 differ in their capacity but they correspond in their external dimensions. The base 6 forms the cover that can be screwed onto each liquid tank 5 and in addition also forms the opening 7 for insertion of the liquid filter 8. In this way, the technical variation in the liquid tanks 5 suitable for the system may be accomplished independently of the mechanical connection of the liquid filters 8 to the entire liquid cooler installation. In the exemplary embodiment shown here, the liquid cooler 8 is inserted into the standardized opening 7 in the base 6 while being brought into connection with the liquid of the liquid tank 5 in a suitable manner at the same time. After being inserted into the liquid filter 8, the opening 7 is closed with a cover 12.

The liquid filter 8 may also be a member of a set of at least two liquid filters 8, the members of which are designed mechanically so that they can each be connected to the liquid tank 5 through the opening 7, but they differ in their filter properties. These properties may include the filter performance, the durability or the alignment with a specific type of liquid or oil.

For example, if the set of liquid coolers 3 consists of three different members and/or elements, such as the sets of fans 4, liquid tanks 5 and liquid filters 8 each consist of three elements, then the customer can select from a system of $3^4=81$ liquid cooler installations with various characteristic values, while the manufacturer of the system must keep on hand essentially only one type of cooler station 1 plus twelve different components to be installed therein. In practice, the sets of parts comprise substantially more elements in some cases, which drastically expands the product pallet.

What is claimed is:

1. A cooler station system, comprising:

at least one liquid cooler, comprising a first distributor box, having a hollow extruded section of aluminum having outwardly open guide grooves, a platform that is pushable onto the liquid cooler by mechanical connecting elements, which are insertable into the guide grooves of the first distributor box, and is fixedly connected to the liquid cooler, wherein the platform is one platform of a set of platforms, wherein each platform of the set of platforms is connectable to the liquid cooler without another platform of the set of platforms being connectable to the liquid cooler simultaneously, wherein each platform of the set of platforms has hydraulic and/or electrical connections which are different from each other, wherein each platform of the set of platforms has mechanical connecting elements for connection to the liquid cooler which are a same as each other, and wherein each platform of the set of platforms has separate connections for a liquid inlet line and a liquid outlet line.

2. The cooler station system according to claim 1, wherein the liquid cooler has a second distributor box having a hollow extruded section of aluminum, which has outwardly open guide grooves for attachment to a base.

3. The cooler station system according to claim 1, further comprising a liquid inlet line and a liquid outlet line, and wherein the first distributor box has an opening, and both the liquid inlet line and the liquid outlet line extend through the opening.

4. The cooler station system according claim 1, wherein at least one platform of the set of platforms has an electric thermometer for measuring a temperature of a liquid.

5. The cooler station system according to claim 1, further comprising a liquid filter.

6. The cooler station system according to claim 1, wherein at least one platform of the set of platforms has at least one flange.

7. The cooler station system according to claim 1, wherein the cooler is one of a set of liquid coolers.

8. The cooler station system according to claim 1, further comprising:

a frame connected to the liquid cooler, by which the cooler station is providable independently, and in which a volume is formed, in which the liquid cooler and one fan are disposable at a same time, and a base on which connections for the liquid cooler, a fan and a liquid tank are provided, and wherein the base has an insertion opening for a liquid filter, which is disposed such that the liquid filter is insertable to protrude into the insertion opening and into the liquid tank when connected to the base.

9. The cooler station system according to claim 8, further comprising:

a fan, a liquid tank, and a liquid filter.

10. The cooler station system according to claim 1, further comprising a liquid inlet line and a liquid outlet line, and wherein the liquid inlet line and the liquid outlet line are in a coaxial arrangement in each platform of the set of platforms, respectively.

11. The cooler station system according to claim 10, wherein the liquid outlet line is disposed around the liquid inlet line.

12. The cooler station system according to claim 1, further comprising a liquid inlet line and a liquid outlet line, and wherein the liquid inlet line and the liquid outlet line are in a coaxial arrangement in the first distributor box.

13. The cooler station system according to claim 12, wherein the liquid outlet line is disposed around the liquid inlet line.

14. A cooler station system, comprising:

at least one liquid cooler, comprising a first distributor box, having a hollow extruded section of aluminum having outwardly open guide grooves, a platform that is pushable onto the liquid cooler by mechanical connecting elements, which are insertable into the guide grooves of the first distributor box, and is fixedly connected to the liquid cooler, wherein the platform is one platform of a set of platforms, wherein each platform of the set of platforms is connectable to the liquid cooler, without another platform of the set of platforms being connectable to the liquid cooler simultaneously, wherein each platform of the set of platforms has hydraulic and/or electrical connections which are different from each other, wherein each platform of the set of platforms has mechanical connecting elements for connection to the liquid cooler which are a same as each other, and wherein each platform of the set of platforms has separate connections comprising a liquid inlet line connection and a liquid outlet line connection.

15. The cooler station system according to claim 14, wherein the liquid cooler has a second distributor box having a hollow extruded section of aluminum, which has outwardly open guide grooves for attachment to a base.

16. The cooler station system according to claim 14, further comprising a liquid inlet line and a liquid outlet line, and wherein the first distributor box has an opening, and both the liquid inlet line and the liquid outlet line extend through the opening.

17. The cooler station system according claim 14, wherein at least one platform of the set of platforms has an electric thermometer for measuring a temperature of a liquid.

18. The cooler station system according to claim 14, further comprising:

a frame connected to the liquid cooler, by which the cooler station is providable independently, and in which a volume is formed, in which the liquid cooler and one fan are disposable at a same time, and a base on which connections for the liquid cooler, a fan and a liquid tank are provided, and wherein the base has an insertion opening for a liquid filter, which is disposed such that the liquid filter is insertable to protrude into the insertion opening and into the liquid tank when connected to the base.

19. The cooler station system according to claim 14, further comprising at least one of a fan, a liquid tank and a liquid filter.

20. The cooler station system according to claim 14, further comprising a liquid inlet line and a liquid outlet line, and wherein the liquid inlet line and the liquid outlet line are in a coaxial arrangement.

* * * * *